US005590807A

United States Patent [19]

Forrest et al.

[11] Patent Number: 5,590,807

[45] Date of Patent: Jan. 7, 1997

[54] REFORMED CONTAINER END

[75] Inventors: Randall Forrest, Hoffman Estates; Timothy Turner, Cary, both of Ill.; Don Thurman, Valparaiso, Ind.

[73] Assignee: American National Can Company, Chicago, Ill.

[21] Appl. No.: 146,234

[22] Filed: Nov. 1, 1993

Related U.S. Application Data

[63] Continuation-in-part of Ser. No. 955,921, Oct. 2, 1992, Pat. No. 5,356,256.

[51] Int. Cl.[6] ..... B65D 7/42

[52] U.S. Cl. ..... 220/608; 220/641; 220/642; 220/623; 220/650

[58] Field of Search ..... 220/608, 269, 220/270, 272, 273, 641, 623, 656

[56] References Cited

U.S. PATENT DOCUMENTS

| | | |
|---|---|---|
| 2,017,460 | 10/1935 | Hothersall . |
| 2,047,830 | 7/1936 | Lofts . |
| 3,259,267 | 7/1966 | Bozek et al. . |
| 3,417,898 | 12/1968 | Bozek et al. . |
| 3,843,014 | 10/1974 | Cospen et al. . |
| 3,907,152 | 9/1975 | Wessely . |
| 3,945,334 | 3/1976 | Ostrem et al. . |
| 3,957,005 | 5/1976 | Heffner . |
| 4,031,837 | 6/1977 | Jordan . |
| 4,036,160 | 7/1977 | Kelley . |
| 4,093,102 | 6/1978 | Kraska . |
| 4,109,599 | 8/1978 | Schultz . |
| 4,129,085 | 12/1978 | Klein . |
| 4,217,843 | 8/1980 | Kraska . |
| 4,408,698 | 10/1983 | Ballester . |
| 4,448,322 | 5/1984 | Kraska . |
| 4,503,989 | 3/1985 | Brown et al. . |
| 4,559,801 | 12/1985 | Smith et al. . |
| 4,571,978 | 2/1986 | Taube et al. . |
| 4,587,816 | 5/1986 | Garcia . |
| 4,587,825 | 5/1986 | Bulso, Jr. et al. . |
| 4,606,472 | 8/1986 | Taube et al. . |
| 4,641,761 | 2/1987 | Smith et al. . |
| 4,704,887 | 11/1987 | Bachmann et al. . |
| 4,713,958 | 12/1987 | Bulso, Jr. et al. . |
| 4,715,208 | 12/1987 | Bulso, Jr. et al. . |
| 4,790,705 | 12/1988 | Wilkinson et al. . |
| 4,809,861 | 3/1989 | Wilkinson et al. . |
| 4,832,223 | 5/1989 | Kalenak et al. . |
| 4,903,521 | 2/1990 | Bulso, Jr. et al. . |
| 4,928,844 | 5/1990 | LaBarge . |
| 4,934,168 | 6/1990 | Osmanski et al. . |
| 4,955,223 | 9/1990 | Stodd et al. . |
| 4,977,772 | 12/1990 | Bulso, Jr. et al. . |
| 4,991,735 | 2/1991 | Biondich . |
| 5,042,284 | 8/1991 | Stodd et al. . |
| 5,046,637 | 9/1991 | Kysh . |

FOREIGN PATENT DOCUMENTS

| | | |
|---|---|---|
| 0-103-074-A2 | 3/1984 | European Pat. Off. . |
| WO89/10216 | 11/1989 | WIPO . |

*Primary Examiner*—Joseph M. Moy
*Attorney, Agent, or Firm*—Wallenstein & Wagner, Ltd.

[57] ABSTRACT

The present invention is a reformed container end and a method of forming the container end. The container end includes a center panel surrounded by a countersink having an inner wall, an outer wall, and a countersink bottom. The countersink bottom includes a first arcuate segment having a small radius and a second arcuate segment having a larger radius. The container end may also include a portion wherein the center panel is slightly expanded and the inner wall is further reformed to direct potential buckling away from the nose of a pour opening panel.

6 Claims, 3 Drawing Sheets

REFORMED CONTAINER END

RELATED APPLICATIONS

This application is a continuation-in-part of Ser. No. 07/955,921 filed on Oct. 2, 1992 now issued as U.S. Pat. No. 5,356,256.

DESCRIPTION

1. Technical Field

The present invention relates generally to closures for containers and more particularly to an improved strength metal closure having a reformed countersink area.

2. Background of the Invention

The packaging industry is continually looking for ways to reduce the amount of metal used in the package while improving or maintaining the integrity and functionality of the package. This is of particular importance in the area of beverage containers due to extremely high volumes. With such large volumes, small reductions in the materials used for each package add up to a very significant savings of money and of metal resources.

One area where a great deal of work has been done to reduce material costs and improve strength is the end wall which closes a conventional, generally cylindrical metal beverage container. As is well known, this end wall, or container end, is less able to withstand internal pressurization of the container than the sidewall for a given thickness of metal. Thus, for example, while the industry has been able to reduce the sidewall of a two-piece aluminum beverage container to about 0.004" in thickness, the container end is on the order of 0.011" to 0.012", depending on the intended purpose and design of a container end. Reduction in the thickness or "gauge" of a container end for a beverage container of a few thousandths of an inch will result in large raw material savings. Because simple reduction of gauge causes an end which may not meet industry standard strength requirements, improving the strength of such container ends allows reduction while meeting industry requirements.

The container end typically has a center panel surrounded by a countersink which is integrally connected to a peripheral flange or curl. The curl is provided to double-seam the container end to the container. Internal pressurization of the container can cause the center panel on the container end to dome, or bulge, upwardly due to axial upward forces. In turn, the axial upward forces acting on the center panel cause radially inward forces on portions of the countersink which may pull it away from the container sidewall allowing the center panel to bulge even higher. A variety of problems are encountered if the center panel rises above the double seam of the container. Historically, this has been compensated for by utilizing a relatively thick container end. However, in order to thin, or downgauge, the container end, an improved container end design was needed in order to help the container end withstand bulging and buckling forces.

Considerable work has been done to improve the buckle strength of a container end through modification of the countersink area, usually in concert with other structural elements of the container end. The conventional practice in making a container end today is to start with a shell that includes a countersink portion between the center panel and the curl. The countersink includes an inner wall and an outer wall joined by a countersink bottom. Typically, the countersink bottom of the shell has a relatively large radius. The inner wall is joined to the center panel by a curved shoulder. The shell is made in a shell press for converting a disk of metal, or cutedge, into a shell. The shell is then processed in a conversion press, where the shell undergoes various operations to be converted to a finished container end. For example, a ring pull or non-detachable tab is attached to the end, and scorelines defining a pour opening panel are provided for a pour hole. A container end maker may purchase standard shells from a vendor or operate its own shell presses.

The structural design of a container end can be advantageously used to reduce the material required to produce the container end. Improved strength resulting from an improved structural design will compensate the container end for loss of strength due to reduction in gauge thickness.

One such design consideration believed to provide additional strength to the container end is to have a small radius (i.e., a tight bend) in the countersink portion of the container end. However, due to the current gauge thickness presently used to form container ends, it is difficult to achieve the desired countersink configuration without thinning or ripping the metal of the container end.

One method of forming a container end of low gauge thickness having a tight countersink radius is disclosed in a co-pending application Ser. No. 07/955,921, filed Oct. 2, 1992. In that Application, a method of reforming a container end to have a single tight countersink radius is disclosed. The countersink portion is reformed progressively in several steps so as to not place undo stress on the metal. However, forming a single tight radius in the countersink bottom has the effect of bringing the inner wall extremely close to the outer wall. This makes it difficult to attach such ends to container bodies using industry standard tooling. Accordingly, a need exists for providing a container end having a countersink bottom with at least a portion having a tight bend, or radius, which can be easily secured to a container body using industry standard tooling.

Another concern associated with low gauge ends is to direct any potential buckling away from certain portions of the container end. As mentioned, the center panel typically includes scorelines which define a pour opening panel. Also, a non-detachable tab is secured to the center panel by a rivet. The tab is pivotally mounted on the rivet so that upward movement of a portion of the tab causes an opposing portion to engage the pour opening panel and break or rupture it along the scorelines to open the pour hole. In recent years, container ends have been made with stay-on tabs and non-detachable pour panels in which the scorelines do not completely surround the pour panel. Thus, a portion of the pour panel remains secured to the center panel after the scoreline is ruptured.

When secured to a container, the center panel of the container end, including the tab, is positioned below the double seam, or "chime," of the container. As the end wall is downgauged, it becomes increasingly vulnerable to a variety of problems resulting from internal pressurization of the container. For instance, the doming problems discussed may lead to undesired openings or scoreline fatigue. Scoreline fatigue can result in leaking, or in more severe cases, the pour panel blowing off the container end and effectively becoming an airborne missile. Additionally, the container end may experience localized buckling, whereby a portion of the container end, typically in the countersink, is deformed axially upwardly above the chime. Localized buckling proximate the pour opening panel can also lead to pour panel blow-off or scoreline fatigue.

As is well known in the art, forming an annular band of reduced thickness along 360° of the shoulder of the center panel provides additional resistance to buckling. This is sometimes referred to in the industry as "coining" the panel shoulder.

U.S. Pat. No. 4,503,989 (Brown et al.) discloses one method of directing potential buckling in a container end. Brown et al. discloses a container end which includes a non-detachable pour opening panel defined by a non-continuous scoreline of reduced residual and a hinge portion located proximate the center of the center panel of the container end. The pour opening panel extends from the hinge portion radially outward towards the panel radius and terminates in a pour opening panel nose. A tab in the form of a pull ring associated with detachable pour opening panels is asymmetrically secured to the pour opening panel by a rivet positioned proximate the pour panel nose and spaced only slightly from the panel shoulder such that the tab and rivet are asymmetrically located on the center panel of the container end. The tab and pour opening panel cooperate in a manner so that upon rupturing of the scoreline, the pour opening panel is pulled upward exposing the non-public side of the pour opening panel.

Brown et al. further discloses a method of pivoting a lifting portion of the tab downwardly. A region of the center panel radially outward from the rivet and extending to the panel shoulder is coined, thereby providing loose metal and permitting the coined region to rise slightly due to internal pressure in the container. The upward movement of the coined region tends to lift the radially outward portion of the tab and pivot the lifting end of the tab downward.

Additionally, Brown et al. discloses coining a segment of the panel shoulder less than 360° centered around the nose of the pour opening panel to direct potential buckling away from the reduced residual portion of the scoreline and thereby reduce fatigue on the scoreline in the instance where buckling has occurred. The coined region radially outward of the tab and the coined segment of the panel radius overlap so that there is no uncoined portion between the coined panel radius segment and the coined region.

However, by directing potential buckling in the manner described, Brown et al. cannot derive the benefits of a full 360° coining of the panel shoulder while maintaining the ability to direct buckling away from the pour opening panel. Furthermore, Brown does not disclose a container end having a reformed countersink segment to provide such direction to potential buckling.

The present invention is provided to solve the above problems and concerns as well as other problems.

SUMMARY OF THE INVENTION

The invention provides a reformed container end typically used to close the open end of an aluminum beverage container, and a method of reforming the container end. The container end is formed from an initial shell configuration and is then subjected to a plurality of reforming operations in a conversion press.

The shell includes a circular center panel surrounded by an annular countersink. The countersink has a generally U-shaped cross-section and includes an inner wall and an outer wall joined by a curved countersink bottom having an initial bottom radius. The center panel is joined to the inner wall of the countersink by a curved shoulder having an initial shoulder radius, sometimes referred to as the panel radius. The outer wall of the countersink is joined to a generally C-shaped flange or curl. The curl is used for seaming the end to a container.

A series of cooperative punches and dies are utilized to gradually reform the shell to have a first arcuate segment having a first countersink radius which is integral with the outer wall of the shell, and a second arcuate segment having a second countersink radius larger than the first countersink radius wherein the second arcuate segment is integral with the first arcuate segment and the inner wall of the shell. As such, the first and second countersink radii define a "compound radius."

To form the compound radius, the shell is subjected to a first reforming operation which begins formation of a first annular arcuate segment having a small radius and a second annular arcuate segment having a larger radius in the countersink bottom. The first and second arcuate segments are formed by wrapping, or reforming, the countersink bottom and portions of the outer wall about a nose portion of a first punch. The nose portion is designed to provide the desired countersink configuration.

To avoid thinning or tearing of the container end, the first reforming operation does not completely set the center panel and allows for springback of the metal. Thus, a slightly tapering angled portion is allowed to develop between the inner wall and the center panel.

In a second reforming operation, the countersink is more tightly wrapped, or reformed, around the nose of a second punch to further define the first and second arcuate segments which form the compound radius. Additionally, the angled portion is reformed into the center panel and the inner wall. In a preferred form of the invention, the shoulder may be coined during this operation to form an annular band of reduced thickness. Preferably, the annular band is coined at a 15° angle with respect to the horizontal. This helps set the reformed configuration.

A third reforming operation may be performed to expand the diameter of the center panel 360° around the panel to improve the container end's rock resistance. Additionally, the third reforming operation may provide additional structure for directing buckling away from the nose of a pour opening panel defined by scorelines on the center panel. The pour opening panel may be formed in one of the above operations or in a separate operation in the conversion press. The nose of the pour opening panel is typically proximate a portion of the shoulder.

The third reforming operation, in addition to expanding the diameter of the center panel 360° around the panel, may include locally further expanding the center panel and the inner wall of the countersink about the portion of the shoulder proximate the nose of the pour opening panel. The center panel may be further expanded by extending the portion of the shoulder proximate the nose radially outward with respect to a remaining portion of the shoulder. Preferably, the further expanded portion is about one inch wide centered about the nose of the pour opening panel. The further expanded portion may be formed by providing a slight projection, or lobe, on an otherwise cylindrical die core used in the third reforming operation. Preferably, the annular band is coined during this operation at the same angle as in the first coining. When this second coining operation is performed, the projection on the die core may provide an additional coined region radially outward from and typically integral with the annular band.

Additional features and advantages of the present invention are described in, and will be apparent from, the detailed description of the preferred embodiments and from the drawings.

DETAILED DESCRIPTION OF A PREFERRED EMBODIMENT

Figure 1:
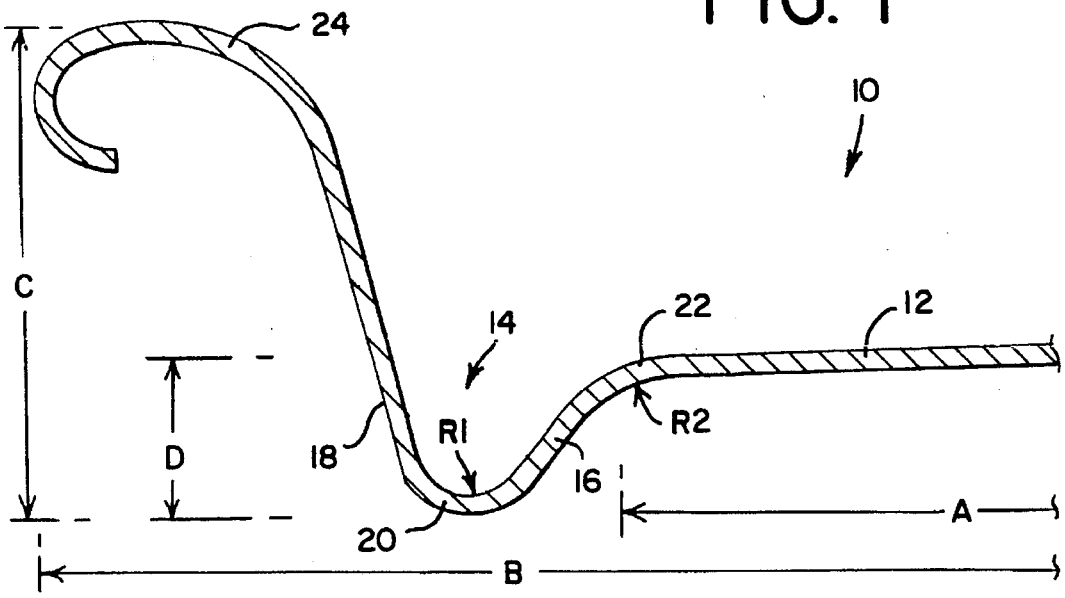
FIG. 1 is a partial cross-sectional view of a shell.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspect of the invention to the embodiment illustrated.

In particular, the preferred embodiment will be described in terms of forming a 206 container end (i.e., a container end for a container having a 2⁶⁄₁₆ inch diameter neck); however, the invention is not limited to a container end for this particular neck dimension.

FIG. 1 discloses a cross-sectional view of an end or shell 10 before any reforming operations have been performed. The shell 10 is formed from a blank, or cutedge, (not shown). The shell 10 includes a generally flat center panel 12 having a panel diameter A. The center panel 12 is surrounded by a circumferential countersink 14 having a generally U-shaped cross-section which includes an inner wall 16, an outer wall 18 and a countersink bottom 20 connecting the inner and outer walls 16,18. The countersink bottom has an initial countersink radius R1. The inner wall 16 of the countersink 14 is connected to the center panel 12 by a curved shoulder 22 having an initial radius R2. The outer wall 18 is connected to a circumferential curl 24 having a diameter B and a generally C-shaped cross-section. The cross-sectional shape and diameter B of the curl 24 remain essentially unchanged during the reforming operations described below.

The shell further includes an initial countersink depth C, measured from the top of the curl 24 to the countersink bottom 20, and a panel height D, measured from the shoulder 22 of the center panel 12 to the countersink bottom 20. The preferred dimensions of the shell are:

| | Inches |
|---|---|
| A | 1.996 |
| B | 2.555 |
| C | .265 |
| D | .072 |
| R1 | .030 |
| R2 | .060 |

The shell 10 is subjected to three reforming operations to obtain a finished container end having a first arcuate segment having a first countersink radius R3 and a second arcuate segment having a second countersink radius R4 of the preferred embodiment. The finished container end 10 is shown in cross-section in FIG. 6. The first and second countersink radii R3,R4 define a compound radius from the initial single countersink radius R1 in the countersink bottom 20.

First Reforming Operation

Figure 2:
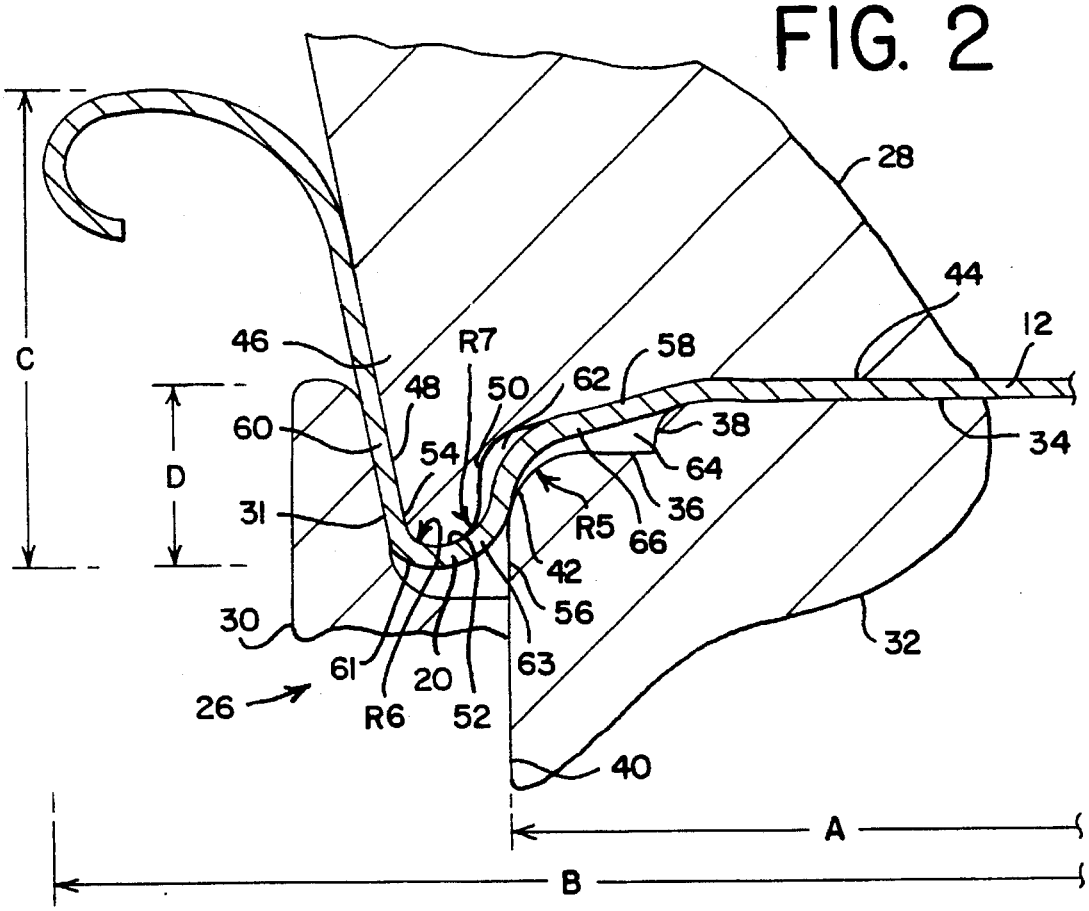
FIG. 2 is a partial cross-sectional view of the shell of FIG. 1 during a first reforming operation in accordance with the invention.

FIG. 2 discloses a first reforming operation to produce a container end from the shell 10 of FIG. 1.

During this operation, a first die 26 and punch 28 come together to reform the shell 10 therebetween. The die 26 is used to engage portions of the lower, non-public, surface of the shell 10 and includes a die ring 30 having an inner surface 31 and a die core 32. The die core 32 includes a generally flat circular surface 34 surrounded by an annular surface 36. A first cylindrical surface 38 connects the annular surface 36 and the circular surface 34. A second cylindrical surface 40 surrounds the annular surface 36 and is connected to the annular surface 36 by a curved shoulder 42 having a radius R5. The circular surface 34 is axially above the annular surface 36 relative to the punch 28.

The punch 28 is used to engage the upper, public, surface of the shell 10 and includes a generally flat circular surface 44 surrounded by an annular nose 46 which projects axially downward relative to the die 26. The nose 46 includes an outer surface 48 and an inner surface 50 connected by a bottom surface 52. The bottom surface 52 has a first arcuate portion 54 integral with the outer surface 48 having a small radius R6, and a second arcuate portion 56 integral with the first arcuate portion 54 and the inner surface 50, and having a larger radius R7. In one embodiment, the radius R7 of the second arcuate portion 56 is greater than twice the radius R6 of the first arcuate portion 54. An angled surface 58 integral with the inner surface 50, connects the inner surface 50 to the circular surface 44.

During the first reform, relative axially movement is effected between the punch 28 and die 26 to reform the shell 10 therebetween. Initially, the inner surface 31 of the die ring 30 engages portions of the lower surface of the outer wall 18 of the shell 10. The punch 28 is then moved axially downward so that the outer surface 48 of the nose 46 engages portions of the upper surface of the outer wall 18. In this manner, the die ring 30 and nose 46 trap and secure a portion 60 of the outer wall 18 between them. Thus, the secured portion 60 and portions of the shell 10 extending radially outward from the secured portion 60 remain essentially unchanged during the first reforming operation.

The punch 28, along with the die ring 30, continues to move axially downward relative to the die core 32. The die ring 30 is typically mounted on a spring element (not shown) to accommodate the downward axial movement. In this manner, the die core 32 engages the lower surface of the shell 10 and reforms portions of the shell 10.

Initially, the shoulder 42 of the die core 32 engages a portion of the lower surface of the inner wall 16 causing a portion of the outer wall 18 radially inward from the secured portion 60, and the countersink bottom 20 to begin to wrap, or reform, around the punch nose 52. This begins formation of a first arcuate segment 61 and a second arcuate segment 63 in the countersink bottom which generally correspond to the first and second arcuate portions 54,56, respectively, of the punch nose 46. Relief zones 62,64 above and below portions of the inner wall 16 and the outer edge of the center panel 12, respectively, are provided to accommodate a certain amount of material springback in the end during the first operation.

As previously mentioned, it is desirable to reform the countersink portion 14 gradually to avoid thinning or tearing of the metal. Accordingly, during the first reform, the countersink bottom 20 and outer wall 18 are not wrapped, or reformed, tightly about the punch nose 52 as shown in FIG. 2.

To further facilitate the gradual reforming, as the die core 32 moves the shoulder 22 of the shell radially outward, an annular angled portion 66 is allowed to form between the inner wall 16 and the center panel 12 of the shell 10. In other words, the panel is not set during the first reforming operation.

The following preferred dimensions are associated with the first reforming operation:

| | Inches |
|---|---|
| A | 2.044 |
| B | 2.555 |
| C | .258 |
| D | .080 |
| R5 | .040 |
| R6 | .010 |
| R7 | .025 |

Second Reforming Operation

The shell 10 is subjected to a second reforming operation using a second die 68 and punch 70. The die 68 includes an annular die ring 72 having an inner surface 74, and a die core 76 having a circular surface 78 surrounded by a cylindrical surface 80. The cylindrical surface 80 is connected to the circular surface 78 by a curved shoulder 82 having a radius R8. The die core 76 includes an annular relief groove 84 which forms a depression on the circular surface 78 spaced slightly radially inward from the shoulder 82.

The punch 70 includes a circular surface 85 surrounded by an annular nose 86 having an outer surface 88, an inner surface 90 and a bottom surface 92 connecting the outer surface 88 and the inner surface 90. The bottom surface includes a first arcuate portion 94 having a radius R6' substantially equal to the radius R6 of the first arcuate portion 54 of the first punch 28, and a second arcuate portion 96 having a radius R7' substantially equal to the radius R7 of the second arcuate portion 56 of the first punch 28. An angled surface 98 connects the inner surface 90 and the circular surface 85.

Similar to the first reforming operation, relative axial movement is effected between the die 68 and punch 70 to further reform the shell 10. Initially, as the punch 70 is moved axially downward with respect to the die 68, the inner surface 74 of the die ring 72 cooperates with the outer surface 88 of the punch nose 86 to trap the secured portion 60 of the shell 10 therebetween.

The punch 70 and the die ring 72 continue to move axially downward with respect to the die core 76. Again, the die ring 72 is typically mounted on spring elements (not shown) to accommodate the axially downward movement. In this manner, the die core 76 engages and reforms portions of the shell 10.

During this operation, the countersink bottom 20 of the shell is more tightly wrapped, or reformed, around the bottom surface 92 of the nose 86. This provides definition to and further forms the first arcuate segment 61 and the second arcuate segment 63 in the countersink bottom 20. The first arcuate segment 61 is formed having a radius R3 which generally corresponds to the radius R6' of the first arcuate portion 94 of the nose 86, and the second arcuate segment 63 is formed having a radius R4 which generally corresponds to the radius R7' of the second arcuate portion 96 of the nose 86. The first and second arcuate segments 61,63 define a compound radius in the countersink bottom 20. The end point of the radius R4 of the second arcuate segment 63 is radially inward of and axially above the end point of the radius R3 of the first arcuate segment 61.

Also, during the second reforming operation, the annular angled portion 66 is reformed into the inner wall 16 and the center panel 12 of the shell 10. This gives greater definition to the shoulder 22 connecting the inner wall 16 to the center panel 12.

As the punch 70 and die ring 72 complete their downward stroke, the angled surface 98 of the punch 70 strikes a portion of the shoulder 22 of the shell 10. The angled surface 98 of the punch 70 and the shoulder 82 of the die core 76 cooperate to form a "coined" annular band 104 on the shoulder 22. The annular band 104 is preferably coined at a 15° angle with respect to the horizontal. Reforming the angled portion 66 followed by coining the shoulder 22 helps set the reformed configuration of the end 10.

The following dimensions are associated with the second reforming operation:

| | Inches |
|---|---|
| A | 2.027 |
| B | 2.555 |
| C | .250 |
| D | .078 |
| R6' | .010 |
| R7' | .025 |
| R8 | .035 |

Third Reforming Operation

The end 10 is further subjected to a third reforming operation using a third die 106 and punch 108. The die 106 includes an annular die ring 110 having an inner surface 112, and a die core 114. The die core 114 includes a substantially annular surface 116 surrounded by a substantially cylindrical surface 118. The cylindrical surface 118 is connected to the circular surface 116 by a curved shoulder 120 having a radius R9. The die core 114 includes an annular relief groove 122 spaced slightly radially inward from the shoulder 120.

Figure 4:
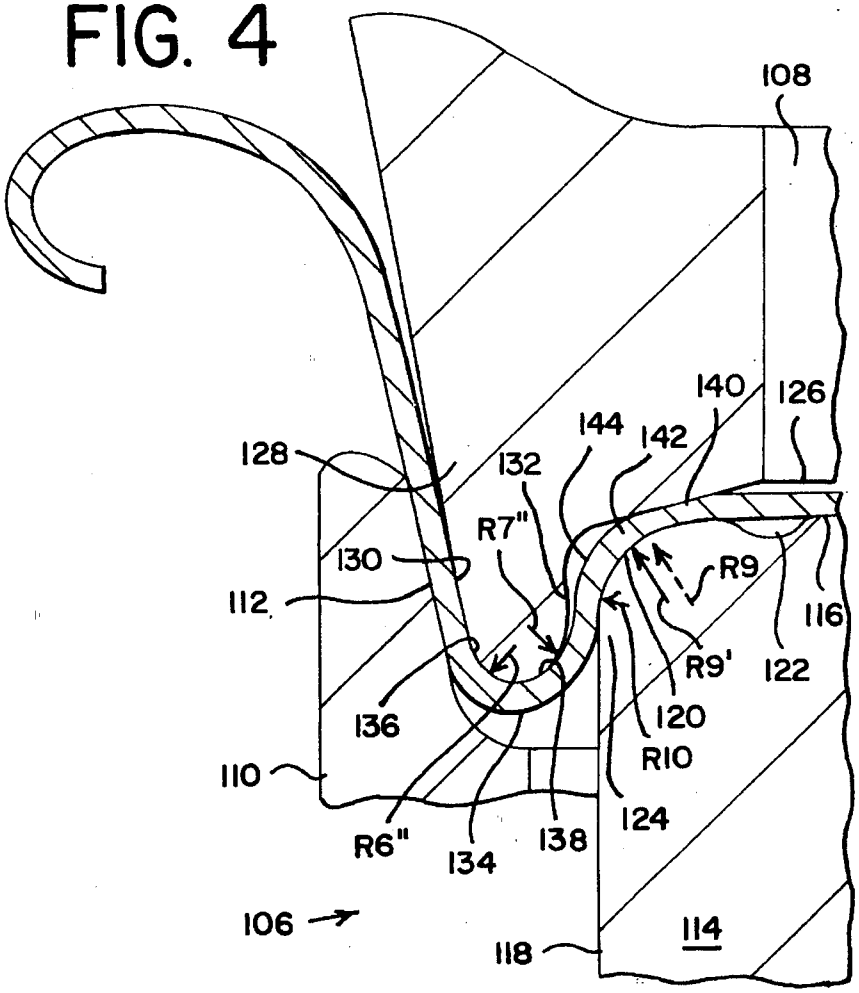
FIG. 4 is a partial cross-sectional view of the shell of FIG. 3 during a third reforming operation in accordance with the invention.
Figure 3:
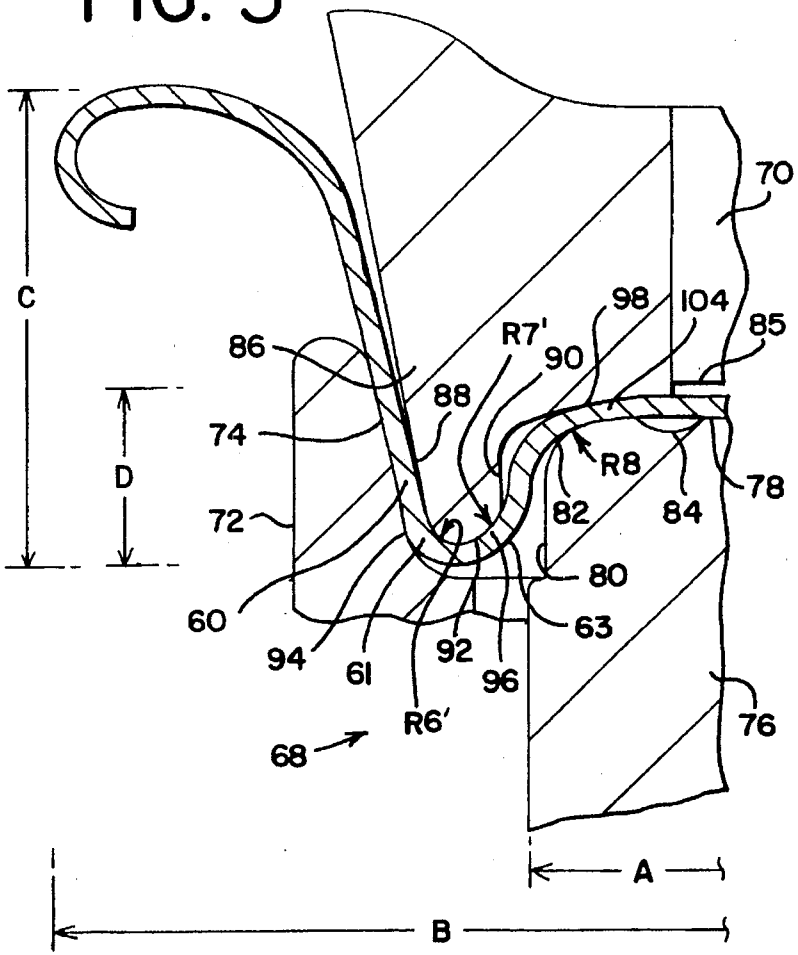
FIG. 3 is a partial cross-sectional view of the shell of FIG. 2 during a second reforming operation in accordance with the invention.

The die core 114 further includes an expanding portion 124 (shown in FIGS. 4 and 6) where the shoulder 120 of the die core 114 has been moved slightly radially outward with respect to the remainder of the die core 114. This is shown in FIG. 4, in that the starting point of the radius R9' of the shoulder 120 of the expanding portion 124 is positioned about 0.0025" radially outward with respect to the radius R9 (shown in phantom) of the shoulder 120 of the remaining portion of the die core 114. A small blend radius R10 is utilized to smoothly join the radius R9' of the expanding portion 124 to the cylindrical surface 118. The expanding portion 124 is preferably about one inch wide and forms a slight lobe or projection on the die core 114. The expanding portion 124 is utilized to further expand radially outward a portion 142 of the shoulder 22 of the center panel 12 of the shell 10 and a portion 144 of the inner wall 16 of the countersink 14 adjacent the expanded shoulder 142. That is, the expanding portion 124 expands the portions 142,144 further than the remaining portions of the center panel 12, which are also expanded as explained below. Additionally, the expanding portion 124 may provide a larger coined region about the expanded shoulder portion 142 of the shell 10 as also explained below.

The punch 108 includes a circular surface 126 surrounded by an annular nose 128 having an outer surface 130, an inner surface 132 and a bottom surface 134 connecting the outer surface 130 and the inner surface 132. The bottom surface 134 includes a first arcuate portion 136 having a radius R6" substantially equal to the radius R6 of the first arcuate portion 54 of the first punch 28, and a second arcuate portion 138 having a radius R7" substantially equal to the radius R7 of the second arcuate portion 56 of the first punch 28. An angled surface 140 connects the inner surface 132 to the circular surface 126.

Similar to the first and second reforming operations, relative axial movement is effected between the die 106 and punch 108. Initially, as the punch 108 is moved axially downward with respect to the die 106, the inner surface 112 of the die ring 110 cooperates with the outer surface 130 of the punch nose 128 to trap the secured portion 60 of the shell 10 therebetween.

The punch 108 and die ring 110 continue to move axially downward with respect to the die core 114. Again, the die ring 110 is typically mounted on spring elements (not shown) to accommodate the axially downward movement. In this manner, the die core 114 engages and reforms portions of the shell 10. The die core 114 expands the center panel 12 to slightly increase the panel diameter A 360° around the center panel 12. A comparison of the panel diameter A between the second operation and the third operation (listed below) shows an increase of about 0.006". This increase in panel diameter A improves the container end's rock resistance and helps tighten the center panel 12. Additionally, this helps straighten the inner wall 16 of the countersink 14.

Figure 5:
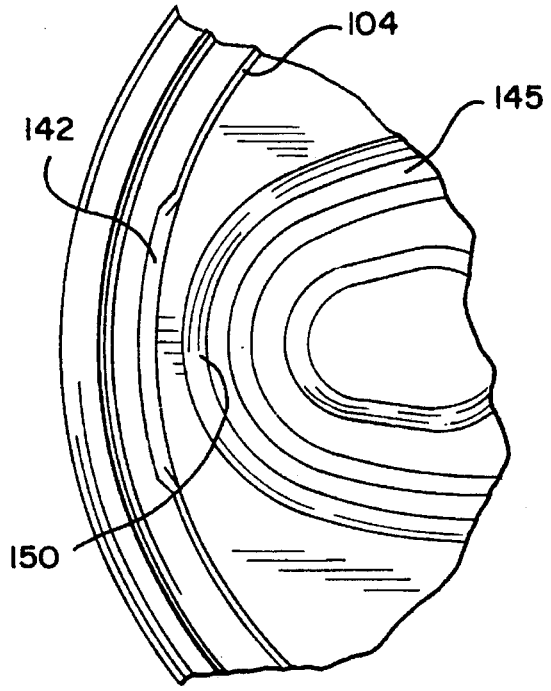
FIG. 5 is a partial perspective view of a container end made in accordance with the invention.

During the third reforming operation, the angled surface 140 of the punch 108 strikes the annular band 104 on the shoulder 22 of the shell 10 at a 15° with respect to the horizontal. Also during this operation, the expanding portion 124 slightly further expands the portion 142 of the shoulder 22 of the center panel 12 radially outward, as well as the portion 144 of the inner wall 16 adjacent the expanded shoulder portion 142. Additionally, as shown in FIG. 5, the expanding portion 124 of the die core 114 and the angled surface 140 of the punch 108 cooperate to form a "coined" region integral with and radially outward from the annular band 104. The expanded shoulder portion 142 and the expanded portion 144 of the inner wall 16 locally strengthen the end and inhibit buckling from occurring at that location. Thus, any potential buckling is directed away from these portions 142,144. This can be utilized to help prevent scoreline fatigue by directing potential buckling away from the portion of the shoulder closest to the scoreline.

Figure 6:
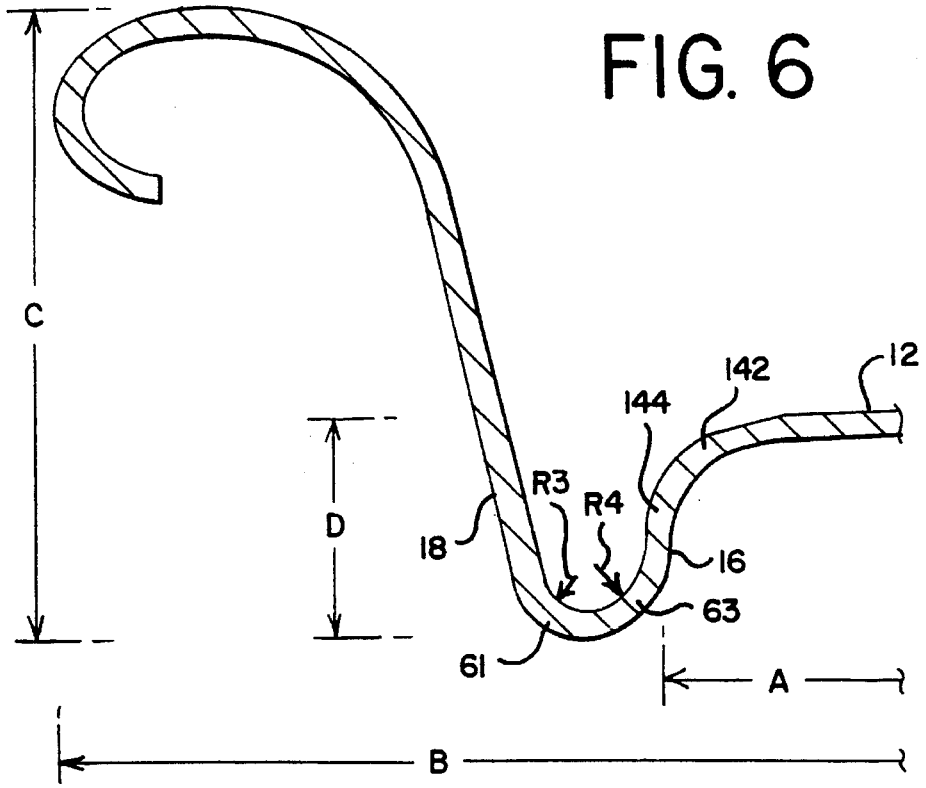
FIG. 6 is a partial cross-sectional view of the container end after the third reforming operation.

The reforming operations are preferably accomplished in a conversion press which performs additional operations to the shell 10 to form the finished container end shown in FIG. 6. Some of these additional operations may be performed concurrently with one of the reforming operations discussed, or as separate operations.

These additional operations include providing scorelines to define a pour opening panel 144, forming a centrally located rivet (not shown) and securing a tab (not shown) to the container end with the rivet 146. The pour opening panel 145 includes a nose 150 proximate the shoulder 22 of the container end.

A debossed panel 152 on the central panel 12 is typically provided after the second reforming operation discussed above. In this manner, the debossed panel 152 helps tighten the central panel 12 by removing slack or "loose" metal. Alternatively, other structures, such as raised ridges along the sides of the pour opening panel, may be used for this purpose.

As suggested above, the strengthened expanded shoulder portion 142 and inner wall portion 144 are preferably aligned about the nose 150 of the pour opening panel 144. Thus, potential buckling is directed away from the pour opening panel to lessen the possibility of such buckling rupturing the scoreline which is typically the weakest portion of the end.

The preferred dimensions associated with the third reforming operation are as follows:

| | Inches |
|---|---|
| A | 2.033 |
| B | 2.555 |
| C | .250 |
| D | .079 |
| R3 | .010 |
| R4 | .025 |
| R6" | .010 |
| R7" | .025 |
| R9 | .035 |
| R9' | .035 |
| R10 | .004 |

While the specific embodiments have been illustrated and described, numerous modifications come to mind without significantly departing from the spirit of the invention and the scope of protection is only limited by the scope of the accompanying Claims.

What we claim is:

1. A circular container end comprising:

a center panel including a pour opening panel defined by scorelines on said center panel;

a substantially annular inner countersink wall surrounding a periphery of said center panel;

a substantially annular curved shoulder integrally joining said inner countersink wall to said center panel completely around said periphery of said center panel, a first segment of said annular shoulder which extends less than 360 degrees around said periphery of said center panel having a first radial distance from a center of said container end, and a second segment of said annular shoulder which extends less than 360 degrees around said periphery of said center panel having a second radial distance from said center of said container end wherein said first radial distance is greater than said second radial distance.

2. The container end of claim 1 wherein said first segment of said annular shoulder is positioned proximate a nose of said pour opening panel to locally strengthen said first segment of said annular shoulder and direct potential buckling away from said nose of said pour opening panel.

3. The container end of claim 1 wherein said first radial distance is about 0.002 inches greater than said second radial distance.

4. The container end of claim 1 wherein said first segment of said annular shoulder is about one inch wide centered about said nose of said pour opening panel.

5. The container end of claim 1 wherein a portion of said annular inner wall adjacent said first segment of said annular shoulder extends outward from said center of said container end a radial distance which is greater than a radial distance from said center of container end of a remaining portion of said annular inner wall.

6. The container end of claim 1 wherein said first segment of said annular shoulder is coined.

* * * * *